US009297162B2

(12) United States Patent
Chouinard

(10) Patent No.: US 9,297,162 B2
(45) Date of Patent: Mar. 29, 2016

(54) WIRE TWISTING APPARATUS

(76) Inventor: Guy Chouinard, Oshawa (CA)

( * ) Notice: Subject to any disclaimer, the term of this patent is extended or adjusted under 35 U.S.C. 154(b) by 1255 days.

(21) Appl. No.: 13/137,500

(22) Filed: Aug. 22, 2011

(65) Prior Publication Data

US 2012/0080116 A1 Apr. 5, 2012

(51) Int. Cl.
*E04B 9/18* (2006.01)
*B21F 7/00* (2006.01)

(52) U.S. Cl.
CPC .... *E04B 9/18* (2013.01); *B21F 7/00* (2013.01)

(58) Field of Classification Search
CPC ..... B21F 7/00; E04B 9/18
USPC ..... 140/93.6, 30, 36, 39, 118, 119, 149; 72/371
See application file for complete search history.

(56) References Cited

U.S. PATENT DOCUMENTS 1,186,781 A * 6/1916 Henry ..... 140/149
1,251,193 A * 12/1917 Dunn ..... 140/149
1,814,188 A * 7/1931 Rietmann et al. ..... 140/93.6
3,332,455 A * 7/1967 Miller ..... 140/115
3,750,720 A * 8/1973 Steigerwald ..... 140/149
3,990,486 A * 11/1976 Quick ..... 140/118
5,927,059 A * 7/1999 Goertz ..... A44C 27/00 140/119
6,256,872 B1 * 7/2001 Landtroop et al. ..... 29/820
6,962,173 B1 * 11/2005 Fishgrab ..... 140/118
8,616,247 B2 * 12/2013 Hopkinson et al. ..... 140/118
2004/0050446 A1 * 3/2004 Ichikawa ..... 140/149

* cited by examiner

*Primary Examiner* — David Bryant
*Assistant Examiner* — Lawrence Averick
(74) *Attorney, Agent, or Firm* — Young & Thompson

(57) ABSTRACT

A rotating arbor has a hollow interior and a forward end provided with a number of fingers which are spaced apart from adjacent fingers by longitudinally extending slits. The hollow interior and the slits are dimensioned such that a conventional concrete pin may be inserted into the arbor and be rotated by it. In one version of the apparatus, three rollers are situated side by side and a space separates each roller from an adjacent roller. A length of wire is positioned such that one of its segments extends through one space and extends to and through the aperture in the head of the concrete pin. A second segment of the wire doubles back from the concrete pin to and through the second space. As the arbor rotates, the segments of the wire twist around each other to attach them to the pin. In another version of the apparatus, the segments the wire are received in grooves formed in two blocks, one stationary and the other pivotal. As the concrete pin rotates, the pivotal block pivots to facilitate twisting of the wire segment in the pivotal block around the other wire segment.

5 Claims, 10 Drawing Sheets

WIRE TWISTING APPARATUS

This application claims priority pursuant to 35 U.S.C. 119 of Canadian patent application No. 2,716,309, filed Oct. 4, 2010, the entire contents of which are herein incorporated by reference.

FIELD OF THE INVENTION

This invention relates to an apparatus used in the assembly of drop ceilings and more particularly to an apparatus for attaching a concrete pin to a wire as part of the process of suspending a drop ceiling beneath an existing ceiling.

BACKGROUND OF THE INVENTION

In buildings composed of concrete walls and concrete slabs forming the floors and ceilings of rooms, it is customary to suspend drop ceilings from the existing ceiling in the rooms. The drop ceilings not only conceal the unattractive concrete surfaces of the existing ceilings but also provide a space between the existing ceilings and the drop ceilings for pipes, electrical wires, pot lights and the like.

The steps usually followed for suspending drop ceilings from existing ceilings of concrete are first to drive concrete pins into the existing ceilings leaving the heads of the pins exposed. A wire is then cut into a number of pieces of predetermined length and each length is passed through an aperture in the head of a concrete pin. Segments of the lengths of wire outside the aperture are then twisted around each other to attach them to the concrete pins and finally, the lengths of wire are fastened to the framework of the drop ceiling to hold it in place.

The wire used for this purpose must be strong enough to bear the weight of the drop ceiling and it must also be relatively inflexible to prevent the ceiling from shifting once it is installed. Because of the wire's very limited flexibility, considerable force is required to twist it and because of this, the process of twisting lengths of wire is very time consuming. For persons engaged in doing so, the process is very onerous.

SUMMARY OF THE INVENTION

I have invented an apparatus for twisting lengths of wire that is easy to operate, carries out the twisting operation quickly and, being an apparatus as opposed to a human being, does not tire over time. Briefly the apparatus of my invention includes: an arbor mounted to be rotated by a such means as an electric drill. The arbor has a longitudinal axis, a longitudinally extending passageway concentric with the axis, and a forward end having at least two fingers, each being spaced apart from an adjacent finger by a longitudinally extending slit which is diametrically opposite another slit. The passageway and the slits are dimensioned such that the pin may be inserted into the arbor in such a way that the shaft is within the passageway and portions of the head are confined within diametrically opposed slits in the arbor in order for the concrete pin and the arbor rotate together as a unit. The apparatus includes a wire locating assembly having at least one space dimensioned to loosely receive a length of wire which extends through the space such that the length of wire advances through the space toward the arbor as the wire is twisted.

DESCRIPTION OF THE DRAWINGS

The apparatus of the invention is described below with reference to the accompanying drawings in which.

DESCRIPTION OF PREFERRED EMBODIMENTS

Figure 1:
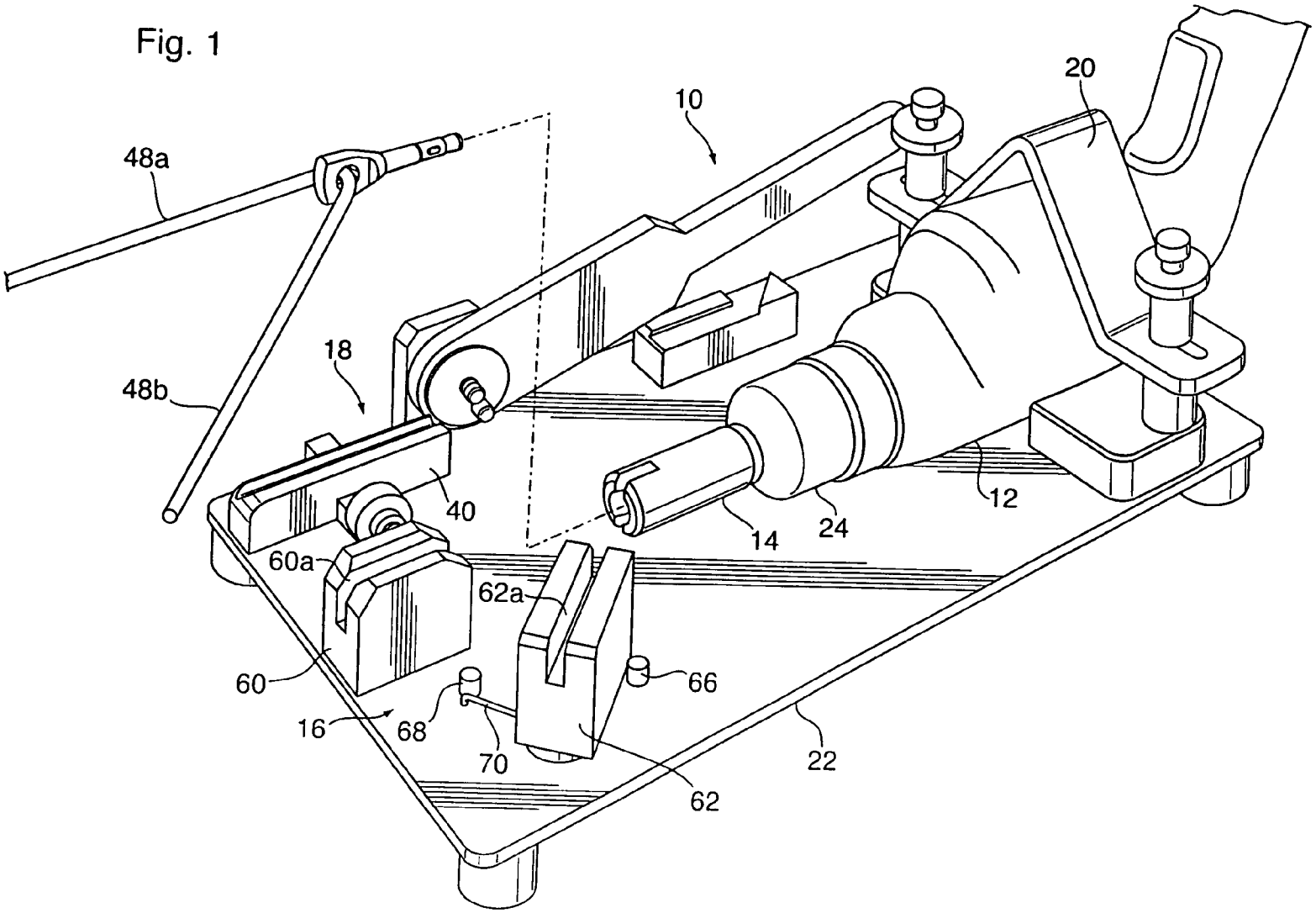
FIGS. 1 and 2 are perspective views of the first embodiment of the apparatus.
Figure 2:
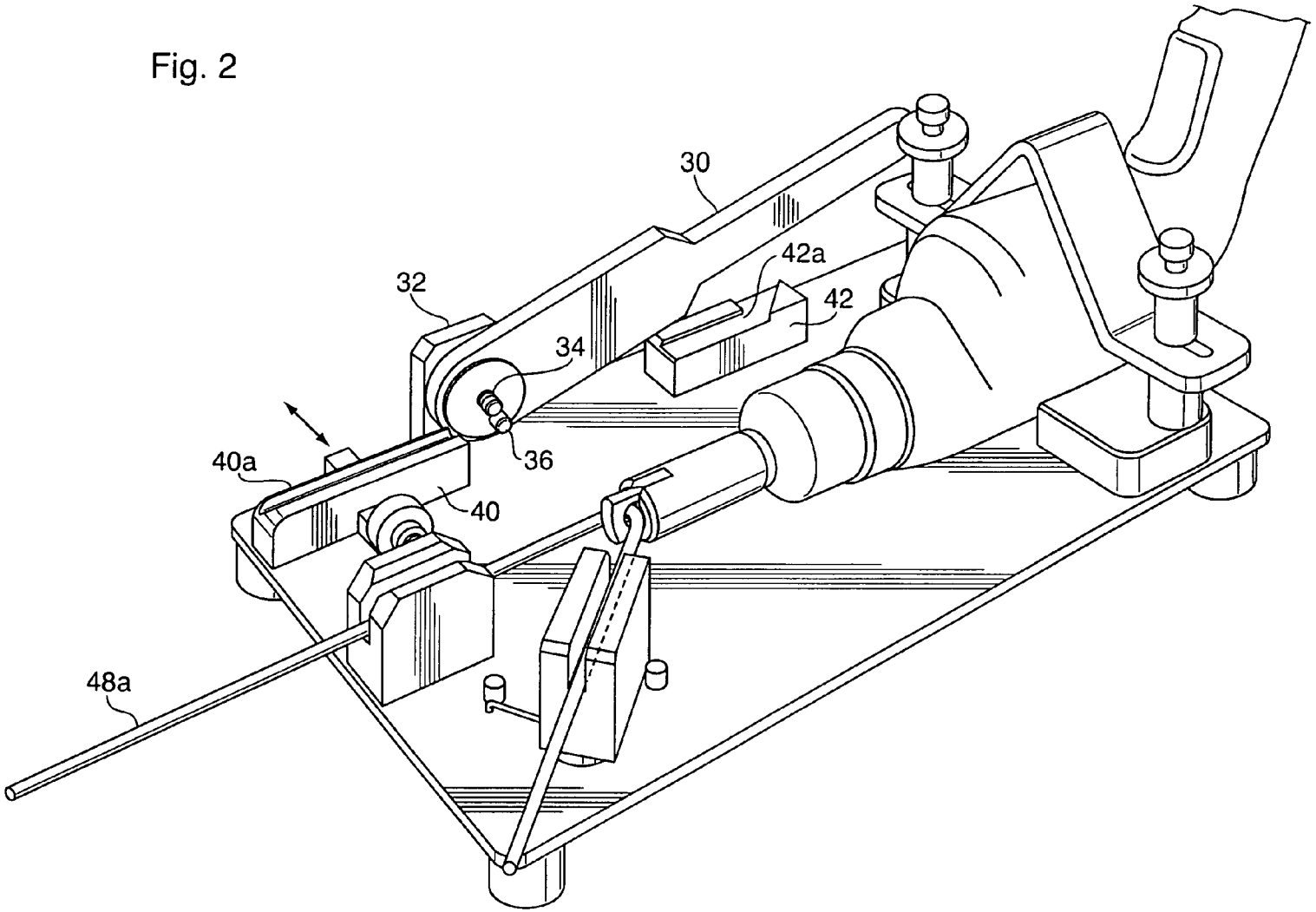

With reference to FIGS. 1 and 2, the apparatus of the invention, generally 10, comprises a drill 12, an arbor 14, a wire locating assembly, generally 16, and a wire bending assembly 18. The drill is a conventional hand operated electrically powered device and is immobilized by means of a bracket 20 which is bolted to a base plate 22. The drill has a conventional chuck 24 for holding the arbor.

With reference to FIGS. 2-6 the wire bending assembly 18 is composed of a handle 30 which is pivotally mounted to an upstanding bracket 32 at the outer edge of the base plate. A knob or protuberance 34 projects outwardly from a side wall of the handle. That knob is located on the axis on which the handle pivots while a second knob or protuberance 36 is eccentrically mounted to the same side wall. The two knobs are separated from one another by a space slightly greater than the thickness of a length of wire to be bend.

Figure 3:
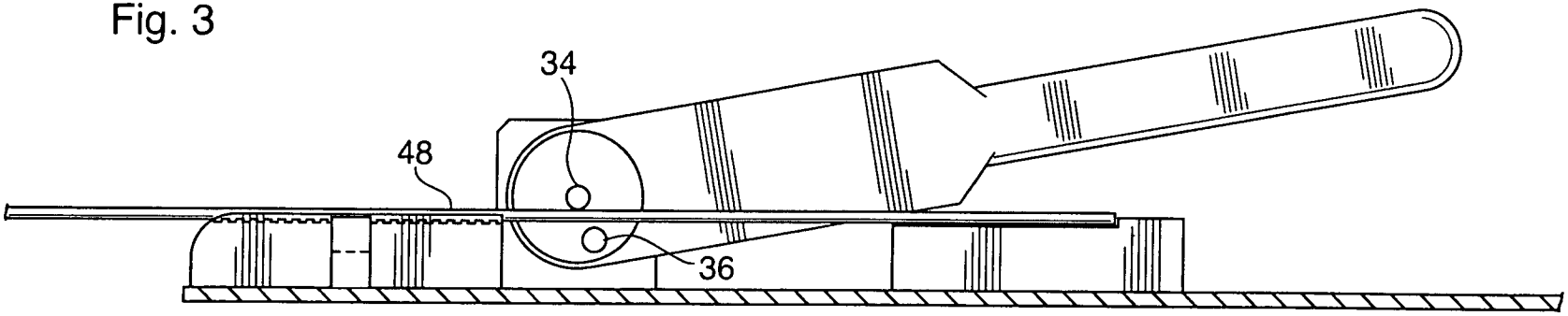
FIG. 3 is an elevation of an assembly for bending a wire to be twisted.

Two wire positioning blocks 40 and 42 are mounted is mounted on the base plate on either side of the handle. Block 40 has a longitudinally extending groove 40*a* on its upper wall while block 42 has a depression 42*a* on its upper surface. The depression serves as a guideway for the handle in its lowermost inoperative position as illustrated in FIG. 3 while the groove accommodates a length a wire as it is being bent.

Figure 5:
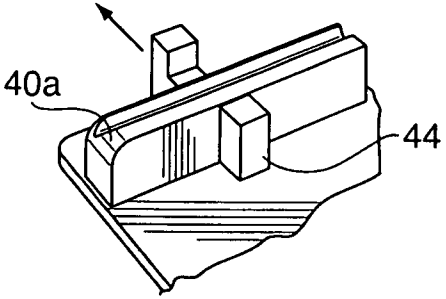
FIGS. 4 and 5 are perspective views of a sliding block of the wire bending assembly.
Figure 4:
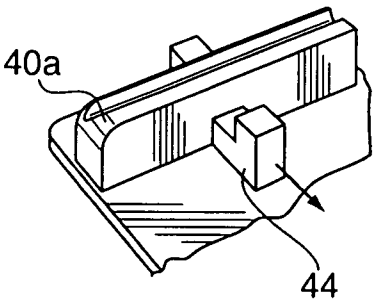
Figure 6:
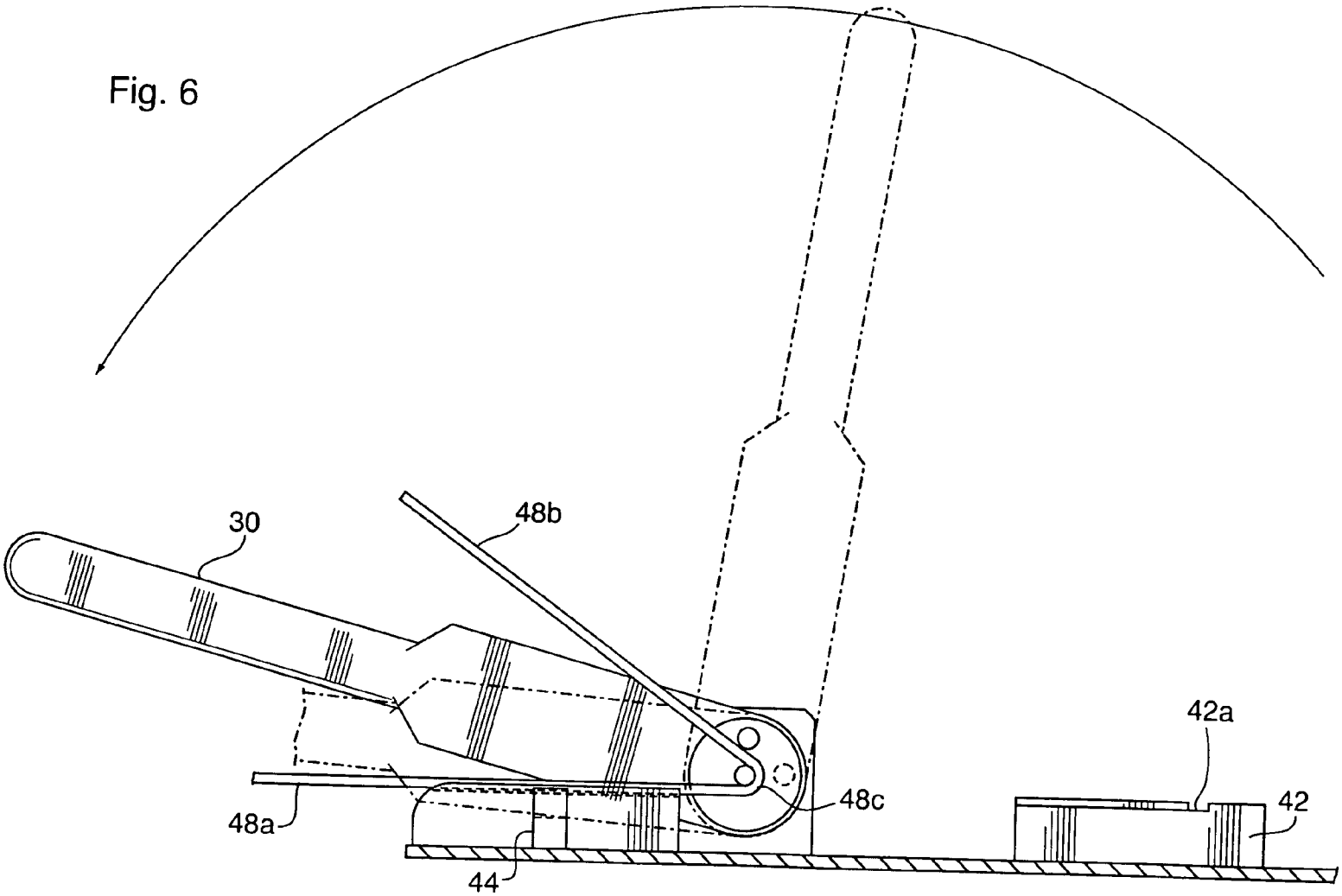
FIG. 6 is an elevation of the assembly as it bends a length of wire.

With reference to FIGS. 4 and 5, the space between the outer wall of the wire positioning block 40 and a U-shaped slider 44 serves as a guideway for the handle in its lowermost operative position illustrated in FIG. 6. By adjustment of the position of the slider, the position of the latter guideway can be adjusted.

The operation of the wire bending assembly is described with reference to FIGS. 3 and 6. A straight length of wire 48 to be bent is placed in groove 40*a* and depression 42*a* and between knobs 34, 36 in the handle. In most applications, the knobs will be approximately midway of the length of the length of wire. The handle is then swung counterclockwise with resulting bending of the wire into a generally V shape having two segments 48*a, b* separated by a bend or apex 48*c*.

Figure 7:
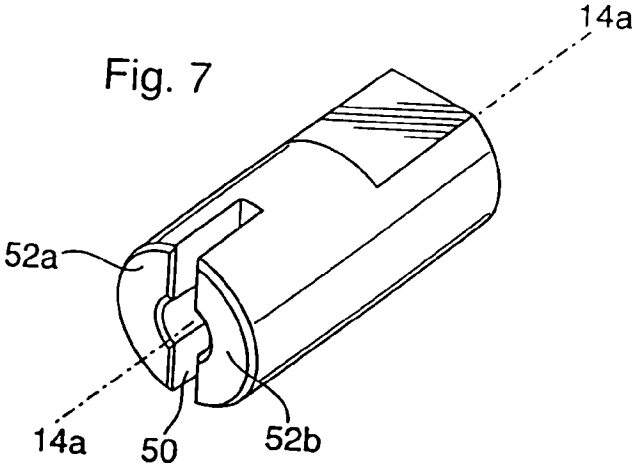
FIGS. 7 and 8 are a perspective view and an end view of an arbor of the apparatus.
Figure 8:
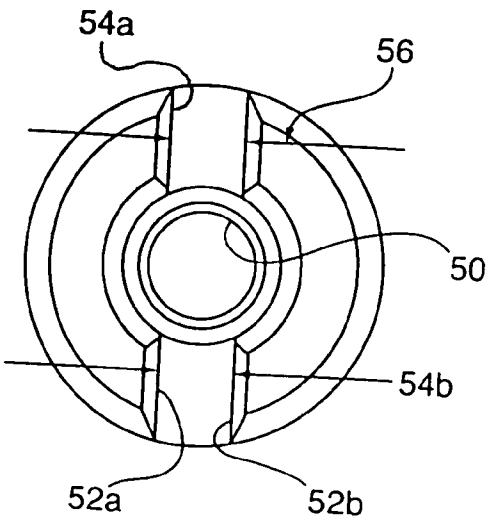

With reference to FIGS. 7 and 8, the arbor has a longitudinal axis 14*a*-14*a* around which it revolves and a cylindrical longitudinally extending internal passageway 50 which is concentric with its axis. At the forward end of the arbor, i.e. the end opposite the chuck, a pair of fingers 52*a,b* are formed. The fingers are longitudinally extending and are separated from one another by two slits 54*a, b* which are diametrically opposed from one another. The width of the slit is indicated 56.

Figure 9:
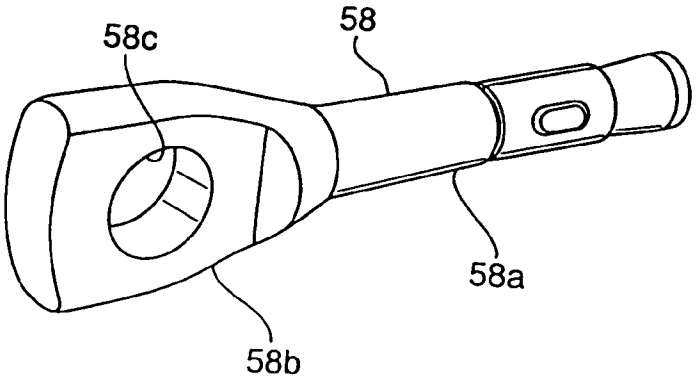
FIG. 9 is a perspective view of a concrete pin to which a length of wire is attached by the apparatus of the invention.

With reference to FIGS. 1, 2 and 9, a conventional concrete pin 58 has a shaft 58*a* which is received in the internal passageway 50 of the arbor. The head 58*b* of the pin is flattened and its outer edges are received in slits 52*a*, 54*a* so that the concrete pin and the arbor rotate together as a unit. The head of the pin has an aperture 58*c* for receipt of a length of wire 48.

With reference again to FIGS. 1 and 2, the wire locating assembly is composed of two guide blocks, a first stationary block 60 and a second pivoting block 62. Each block has a groove on its upper wall for receipt of a length of wire. The groove in the first or stationary block has a first side wall 60*a* which defines the groove. The groove serves as an opening, referred to below as the "first opening" for receipt of a first segment 48*a* of the length of wire. The groove in the second or pivoting block has a first side wall 6062*a* which defines the groove. The latter groove in turn serves as an opening, referred to below as the "second opening" for receipt of a segment 48*b* of the length of wire.

The first guide block 60 is fixed permanently to the base plate and is positioned such that its groove directs a first segment 48*a* of the length of wire within the groove so that the longitudinal axis of the length is substantially an extension of the longitudinal axis 14*a*-14*a* of the arbor.

Figure 11:
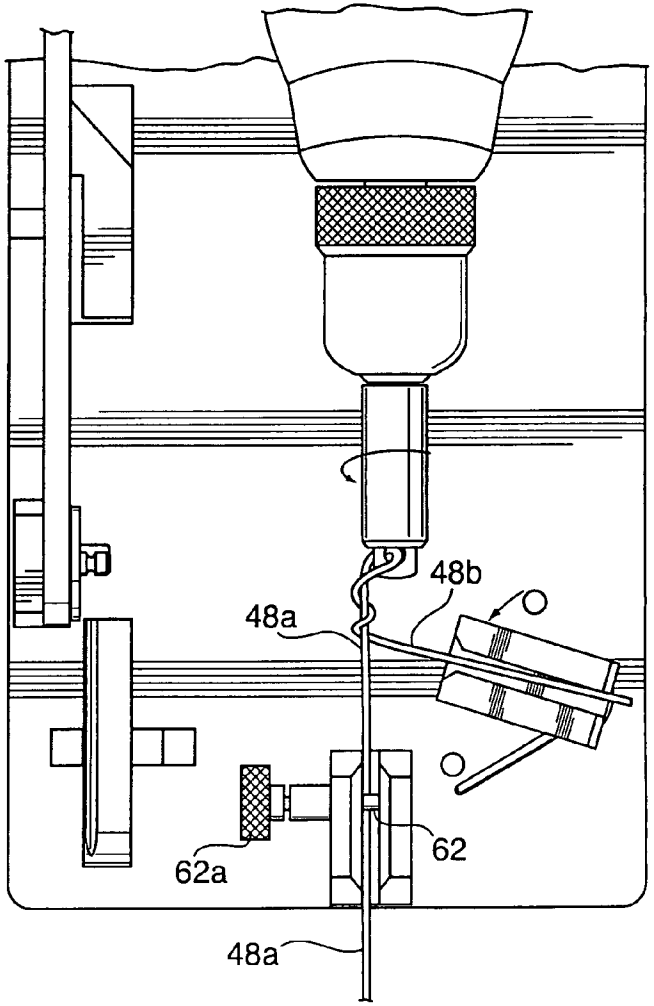
FIGS. 10, 11 and 12 are plan views of the apparatus of the invention showing the manner in which a length of wire is attached to a concrete pin.
Figure 10:
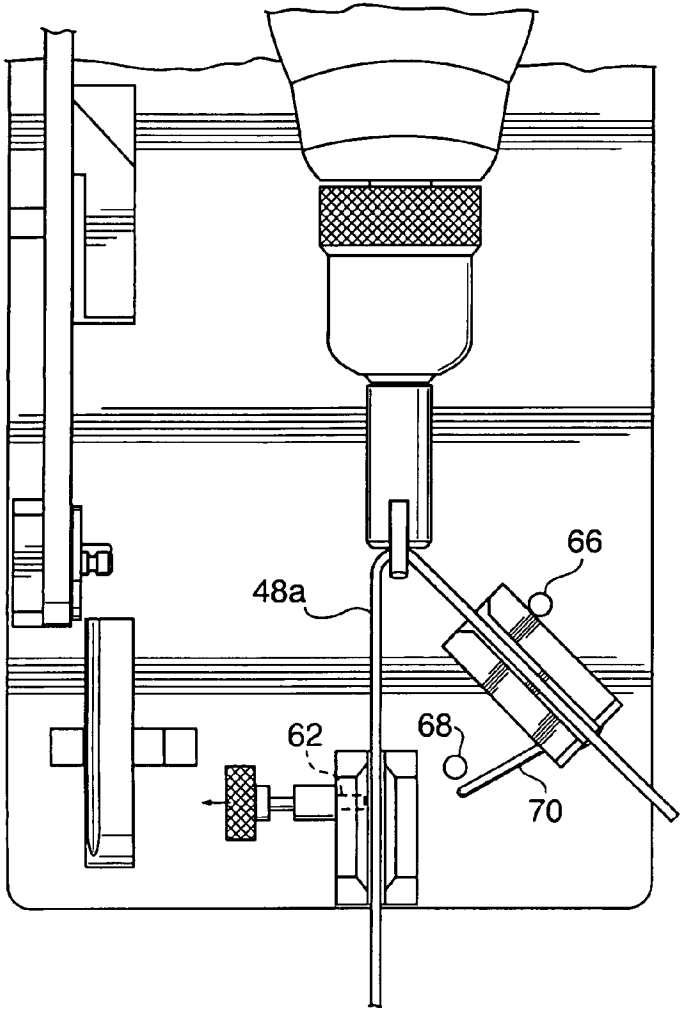
Figure 13:
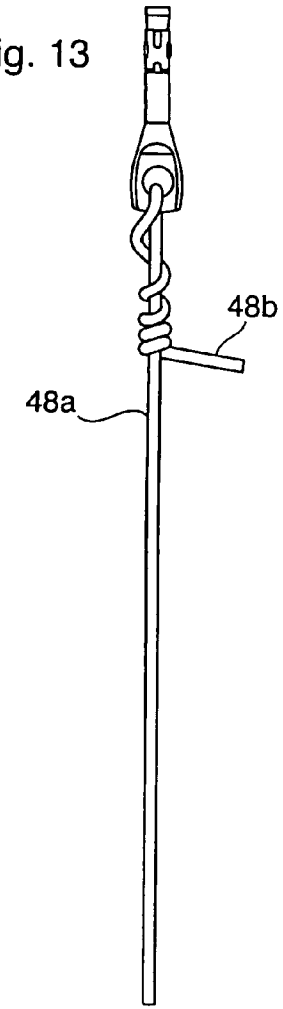
FIG. 13 is a plan view of a length of wire twisted around a concrete pin.

With reference to FIGS. 10 and 11, a spring loaded locking pin 62 serves to hold segment 48*a* of the length of wire in place within the groove while the wire twists in the manner described below, The locking pin is normally within the groove until it is manually withdrawn by means of its handle 62*a*. When the locking pin is withdrawn from the position illustrated in FIG. 11 to the position illustrated in FIG. 10, the segment 48*a* of the length of wire within the groove can be lifted from the groove and replaced by another length of wire.

It will be understood that the locking pin does not interfere with horizontal movement of the wire segment in the groove during the twisting operation but prevents the segment from bending upward or separating from the groove during this time.

With reference again to FIG. 1 and to FIGS. 10-13 the pivoting guide block is positioned such that its groove 62*a* is offset from the axis 14*a*-14*a* of the arbor. The block pivots from a starting position as illustrated in the FIG. 10 in which one of its side walls is adjacent to knob 66 to an end position in which its other side wall is adjacent to knob 68. In the starting position, the forward end of the guide block faces the arbor while in the end position it faces the stationary block.

Figure 12:
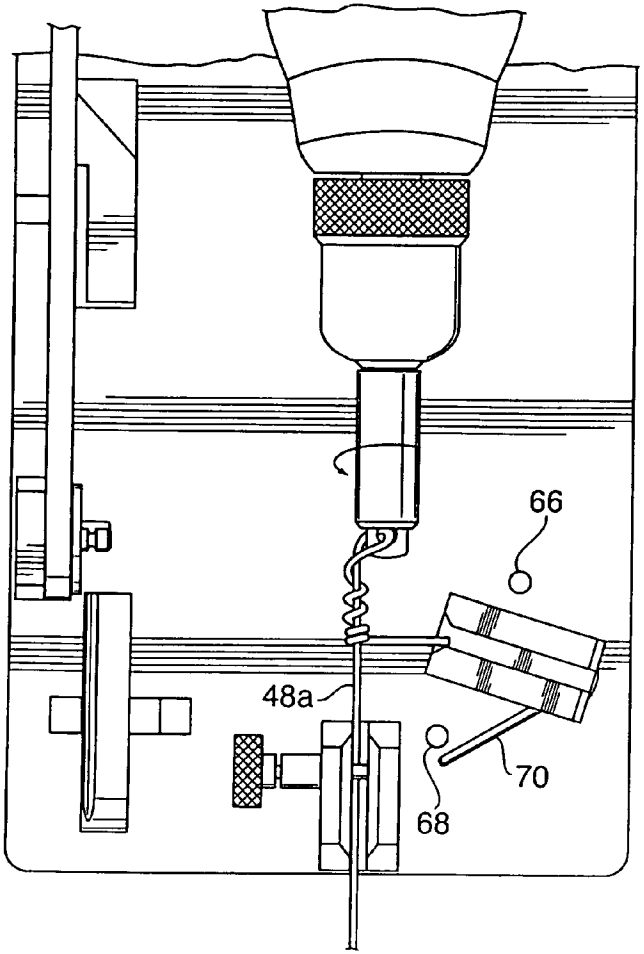

A spring 70 biases the stationary guide block into the starting position. However as the arbor revolves counterclockwise, segment 48*b* of the length of wire within the groove overcomes the bias of the spring and causes the guide block to pivot counterclockwise as illustrated in FIGS. 11 and 12. As the guide block pivots, segment 48*b* of the length of wire advances from the groove and wraps itself around the segment of wire 48*a* closer to the bend in the length of wire To summarize, in the starting position groove or opening 62*a* directs wire within the groove toward the arbor but as the block pivots toward the final position, the groove directs the wire an increasing distance from the arbor. As it does so segment 48*b* of the length of wire wraps itself around segment 48*a* and increasing distance from the bend in the length of wire.

With reference to FIG. 14-17, a second embodiment of the wire twisting apparatus of the invention is illustrated. The apparatus includes an arbor 80 having the same structure as arbor 14 of the first embodiment of the invention except that instead of two fingers at its forward end, arbor 80 has four fingers 82 spaced equidistantly around the circumference of the forward end and each finger is separated from the adjacent two fingers by slits 84. The arbor is rotated by a conventional drill (not illustrated) as before but is mounted eccentrically to chuck 86 and not concentrically as in the arbor of the first embodiment of the invention.

The wire locating assembly of FIGS. 14-17 is composed of three rollers, two outer rollers 90*a, b* and a central roller 90*c* between the other two. The rollers are rotatably mounted to spindles 92 which are bolted to base plate 94. Preferably, the axes of rotation of the rollers are normal to the longitudinal axis of the arbor.

The central roller is composed of lower and upper components A,B respectively, of unequal outer diameters, the upper component having a smaller diameter than the lower. The lower component contacts the outer walls of the outer rollers and rotates with them while the upper component does not contact the outer roller. Rather, there are first and second openings 96*a,b* respectively, between the component and the two outer rollers and those openings are adapted to receive first and second separate segments 98*a,b*, respectively, of a length of wire. The first and second openings are defined by first and second side walls, i.e. the walls of the rollers.

A keeper 100 is pivotally attached to the spindle of outer roller 90*a*. The keeper has a notch 102 in its outer end for receipt of the spindle of the other outer roller 90*b*. By means of the keeper, the spaces between adjacent rollers are closed to confine the segments of wire within the spaces 96.

Figure 14:
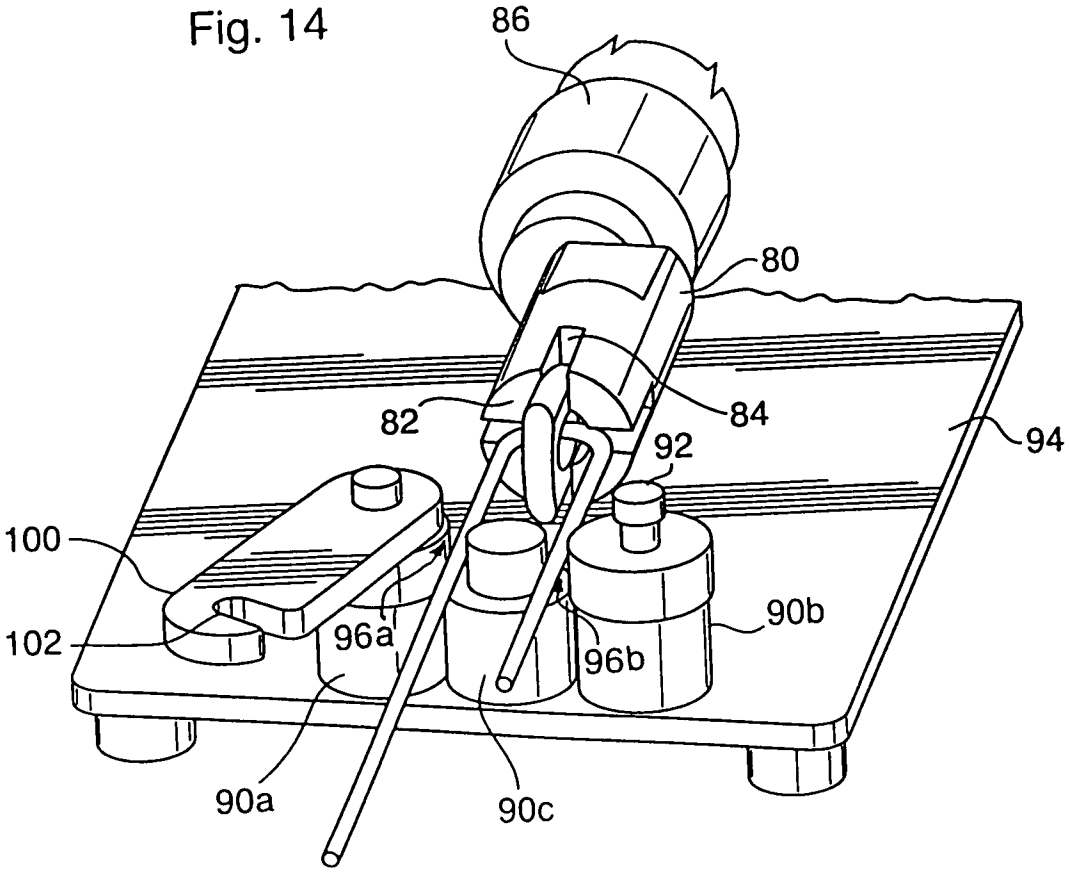
FIGS. 14 and 15 are perspective views of a second embodiment of the apparatus of the invention.
Figure 16:
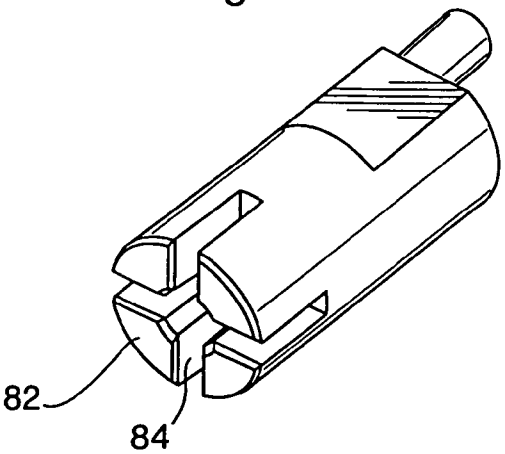
FIGS. 16 and 17 are perspective view and end view of the arbor in the second embodiment of the apparatus.
Figure 17:
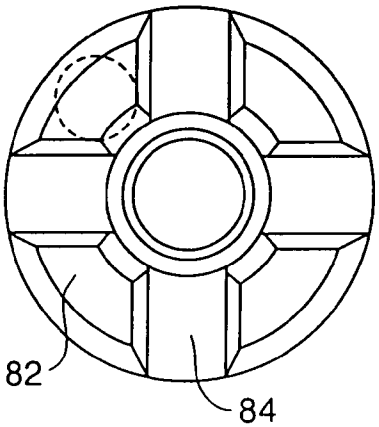
Figure 15:
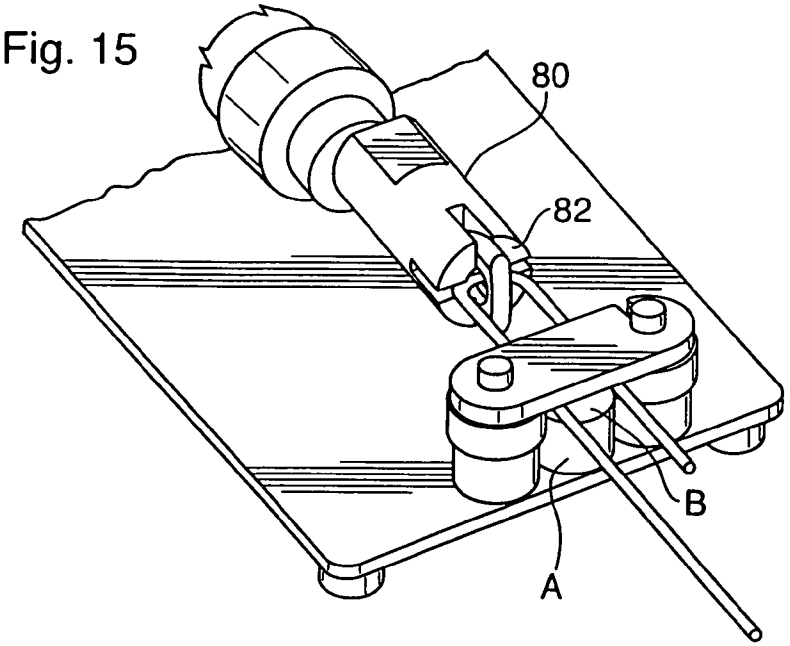

In operation, and with reference to FIGS. 14 and 15, a concrete pin is first inserted into the arbor such that the shaft is within the passageway of the arbor. The pin is then positioned such that outer portions of the front and back walls of the head of the pin are located in diametrically opposed slits 84 in the arbor.

The wire is then cut into a length having a length approximately 3-4 half times the distance between an existing concrete ceiling and a drop ceiling in the course of construction. The length of wire is then inserted into the aperture in the concrete pin until the lengths of the two segments of the wire on opposite sides of the aperture are approximately equal. The keeper of the wire locating assembly is then opened to allow one segment of the wire to be positioned in the space between one outer roller and the central roller while the other segment is positioned in the other space The keeper is then closed to confine the segments of wire in the two spaces.

The drill is then activated to cause the arbor to rotate and as it rotates, the two segments of the length of wire twist around each other with resulting attachment of the wire to the concrete pin. The concrete pin is then ready to be driven into a concrete ceiling. Once driven in, the wire can be used as a hanger to attach the drop ceiling in place.

Figure 18:
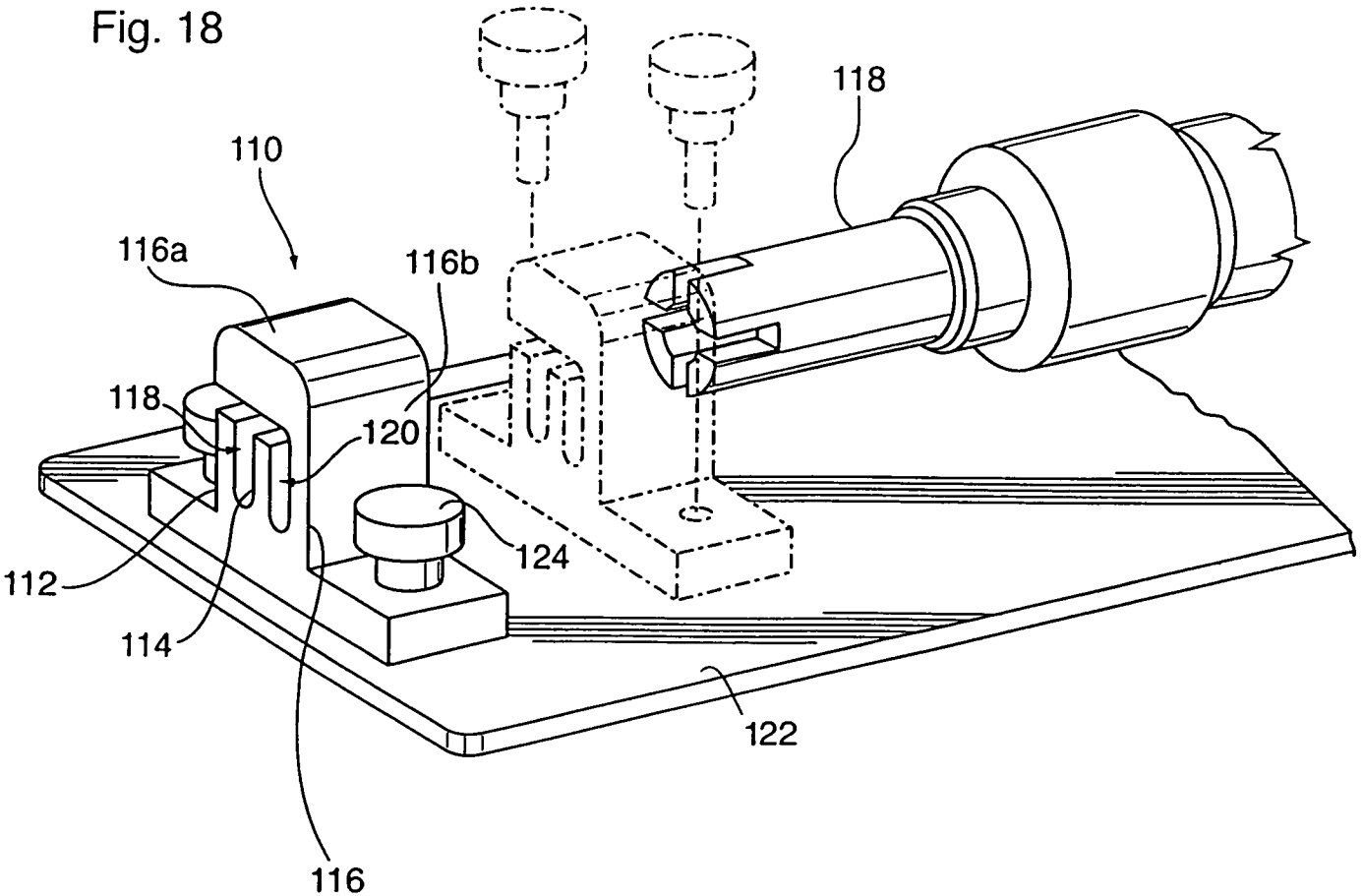
FIG. 18 is a perspective view of a third embodiment of the apparatus of the invention. Like reference characters refer to like parts throughout the description of to drawings.

With reference to FIG. 18, the illustrated arbor 118 is the same as arbor 80 of the second embodiment of the invention however the wire twisting assembly is not. The latter assembly consists of a guide block, generally 110 which has a pair of dividers 112, 114 and an inverted L-shaped end wall 116. The latter wall has an upper horizontal component 116*a* which is spaced vertically above the dividers and a vertical component 116*b* which is spaced apart from the dividers. There is a first opening 118 between the two dividers and a second opening 120 between the vertical component of the end wall and the adjacent divider 114. Those two spaces accommodate separate segments of a wire (not illustrated) to be twisted.

Guide 110 is attached to the base plate 122 be means of a pair of spring loaded locking pins 124. The guide block can be advanced toward the arbor or withdrawn from it by means of the locking pins and recesses (not illustrated) in the upper wall of the base plate which receive the locking pins.

It will be understood, of course, that modifications can be made in the structure of the apparatus of the invention without departing from the scope and purview of the invention as defined in the appended claims. For example, in FIGS. 1 and 2, the longitudinal axis of arbor 12 is shown as being coaxial with the axis of rotation of the chuck but its axis may be offset from the axis of the chuck as in the second embodiment of the invention without departing from the subject invention.

I claim:

1. An apparatus for attaching a V-shaped length of wire to a pin having a shaft and a head having an aperture for receipt of said length of wire, said wire when so received having first and second segments on opposite sides of said aperture, said apparatus comprising:

an arbor mounted for rotation and having a longitudinal axis, a longitudinally extending passageway and a forward end provided with at least a pair of fingers spaced apart from one another by slits, said arbor being dimensioned such that said pin may be removably inserted into said arbor so that said shaft is within said passageway and said head is received within said slits and so that as said arbor rotates so too does said pin; and a wire locating assembly having a stationary guide block and a pivotal guide block, said blocks being spaced apart from one another, a first opening formed in said stationary block and defined by spaced-apart first walls, a second opening formed in said pivotal block and defined by spaced-apart second walls, said first opening adapted to receive said first segment and said second opening being adapted to receive said second segment, said first walls being so positioned and dimensioned in order to orient said first segment on a line which is substantially an extension of said longitudinal axis of said passageway, and said second walls being positioned and dimensioned so as to cause said second segment to wrap itself around said first segment as said pin rotates.

2. The apparatus of claim 1, wherein both said first and second walls are positioned and dimensioned to direct said second segments toward said arbor.

3. The apparatus of claim 1, wherein said second walls are positioned and dimensioned to direct said second segment towards said first segment.

4. The apparatus of claim 1, wherein each said opening is in the shape of a groove.

5. The apparatus of claim 1, wherein said second walls are positioned and dimensioned such as to offset said second segment of wire from said longitudinal axis.

* * * * *